US005794305A

United States Patent [19]

Weger

[11] Patent Number: 5,794,305

[45] Date of Patent: Aug. 18, 1998

[54] ARTICULATION DEVICE FOR A VACUUM CLEANER

[76] Inventor: Kenneth J. Weger, 1001 E. Lilac Dr., Tempe, Ariz. 85281

[21] Appl. No.: 773,799

[22] Filed: Dec. 17, 1996

[51] Int. Cl.[6] ..... A47L 5/28

[52] U.S. Cl. ..... 15/411; 15/339; 15/340.2; 180/6.6; 180/19.2; 280/47.11

[58] Field of Search ..... 15/339, 361, 411, 15/340.2; 180/6.24, 6.6, 19.2, 19.3, 209; 280/47.11

[56] References Cited

U.S. PATENT DOCUMENTS

| | | | |
|---|---|---|---|
| 1,318,881 | 10/1919 | Kelley | 15/411 X |
| 2,038,697 | 4/1936 | Winslow | 15/411 X |
| 2,530,886 | 11/1950 | Maisel | 280/47.11 |
| 2,589,679 | 3/1952 | Dennesen | 280/47.11 |
| 3,507,511 | 4/1970 | Seidel | 280/47.11 |
| 5,584,095 | 12/1996 | Redding et al. | 15/411 |

FOREIGN PATENT DOCUMENTS

| | | | |
|---|---|---|---|
| 2707562 | 9/1977 | Germany | 180/209 |
| 1598691 | 9/1981 | United Kingdom | 280/47.11 |

*Primary Examiner*—Chris K. Moore
*Attorney, Agent, or Firm*—Leydig, Voit & Mayer, Ltd.

[57] ABSTRACT

A vacuum cleaner having an articulation mechanism which includes hemispherically shaped rearward wheels and spaced forward wheels, and a base member which pivotably couples the front and rear wheels so that the rearward wheels may be pivoted in a plane substantially vertical to the surface to be vacuumed such that only one of the rearward wheels in disposed on the surface when the rearward axis is pivoted from a horizontal. As the vacuum is pushed forward or pulled backward, the vacuum cleaner turns toward the side in which the rearward wheel is disposed on the surface to be vacuumed.

13 Claims, 7 Drawing Sheets

ARTICULATION DEVICE FOR A VACUUM CLEANER

FIELD OF THE INVENTION

This invention relates generally to upright vacuum cleaners, and more specifically to a mechanism for steering and articulating a vacuum cleaner or other wheeled device.

BACKGROUND OF THE INVENTION

Upright wheeled devices, such as vacuum cleaners, lawn mowers, and the like are often difficult to turn due to the placement and manner in which the wheels are secured. While these devices may be necessities in daily life, they may be particularly difficult to maneuver and turn for individuals having physical impairments such as arthritis or the like.

OBJECTS OF THE INVENTION

The primary object of the invention is to provide an upright vacuum cleaner which may be easily and conveniently utilized by individuals with a physical impairment, such as arthritis. A more specific object is to provide a vacuum cleaner which may be easily maneuvered and turned.

A related object is to provide a vacuum cleaner wherein the brushes and the underside of the vacuum cleaner may be easily accessed. Another object is to provide a vacuum cleaner which includes accessories, such as a handle, on/off switch, and cord storing mechanism which may be easily utilized by those with physical impairments.

Yet another object is to provide means by which a wheeled device, such as a lawn mower or the like, may be easily maneuvered and turned.

BRIEF SUMMARY OF THE INVENTION

In accomplishing these and other objectives, there is provided a vacuum cleaner which may be easily used and maneuvered, even by those having a physical impairment, such as arthritis. The vacuum cleaner includes various features which render the device "user-friendly."

Among other features, the vacuum cleaner includes an articulation device by which the vacuum cleaner may be easily maneuvered and turned. The articulation device includes spaced forward wheels and a pair of hemispherically shaped rearward wheels. The forward and rearward wheels are coupled by a base member which permits the axis of the rearward wheels to pivot in a plane which is generally perpendicular to the surface to be vacuumed. An upright portion, which includes a handle, is coupled to the rearward wheels and may be used to cause the pivoting motion of the rearward axis.

When the rearward axis is pivoted from a generally horizontal position, one of the hemispherical rearward wheels is lifted from the surface so that the vacuum cleaner rides on the forward wheels and the remaining hemispherical rearward wheel. As the vacuum cleaner is propelled forward or backward, it turns to the side on which the remaining rearward hemispherical wheel is disposed along the surface. The degree to which the vacuum cleaner turns is dependant upon how far the rearward axis is tilted from a horizontal position, that is, the further the axis is tilted, the smaller the effective radius of the hemispherical wheel and the tighter the turn. This type of articulation device may likewise be applied to other wheeled devices, such as lawn mowers or carts.

The vacuum cleaner may additionally be provided with a rear wheel housing which includes a stabilizing channel. The rear housing is secured to and pivots with the rearward hemispherical wheels. A hood portion, which is coupled to the front wheels, is provided with an arched element which is disposed in the channel. As the rearward wheels are pivoted, the channel slides along the arched element, further stabilizing the pivoting motion of the rearward wheels.

As an added feature, the arched element may be used as a handle to pivot the hood up and forward so that the user may access the underside of the vacuum cleaner without lifting and turning the entire vacuum over. Other features of the vacuum cleaner which facilitate usage include an inverted U-shaped handle, a large, centered on/off button, and an automatically retractable cord.

These and other features and advantages of the invention will be more readily apparent upon reading the following description of a preferred exemplified embodiment of the invention and upon reference to the accompanying drawings wherein:

While the invention will be described in connection with certain preferred embodiments, there is no intent to limit it to those embodiments. On the contrary, the intent is to cover all alternatives, modifications, and equivalents included within the spirit and scope of the invention as defined by the appended claims.

DESCRIPTION OF THE PREFERRED EMBODIMENT

Figure 1:
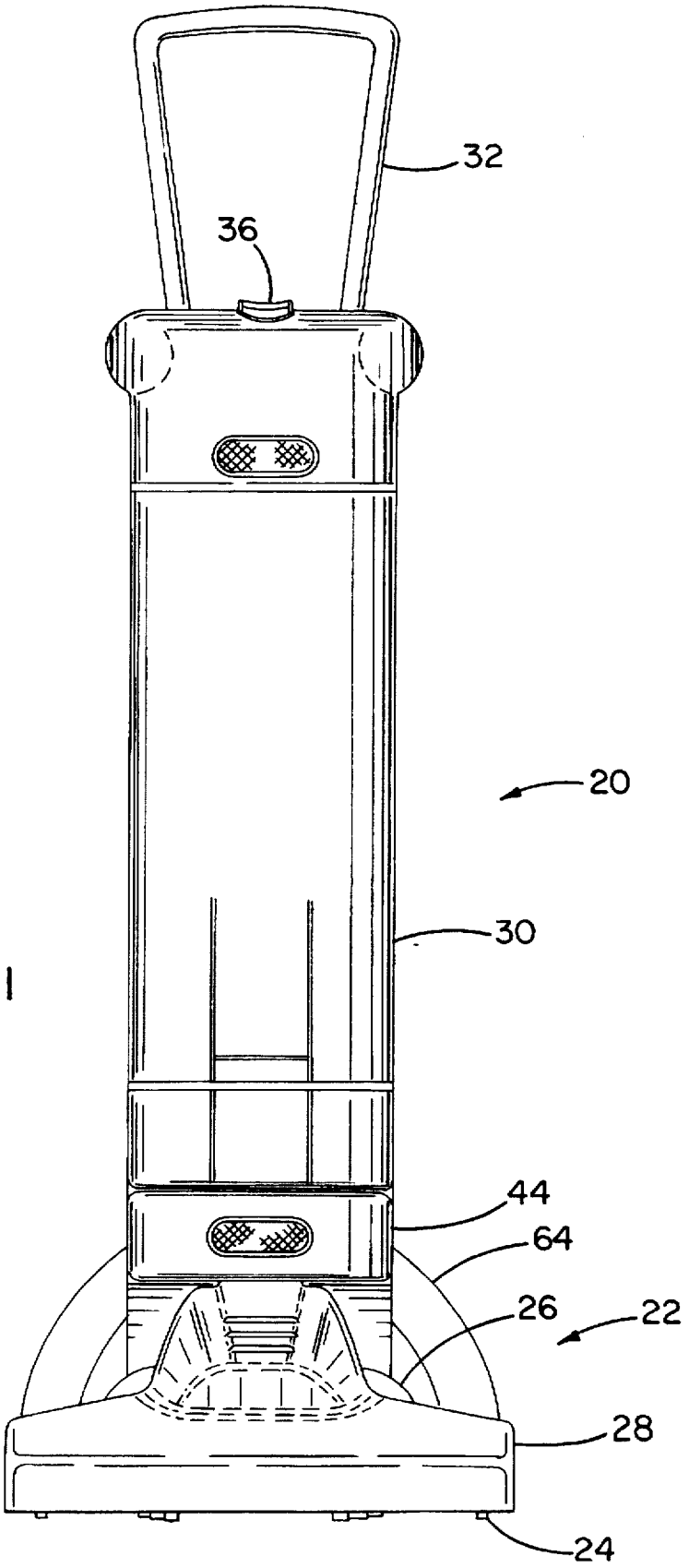
FIG. 1 is a front elevational view of a vacuum cleaner constructed in accordance with teachings of the invention.
Figure 2:
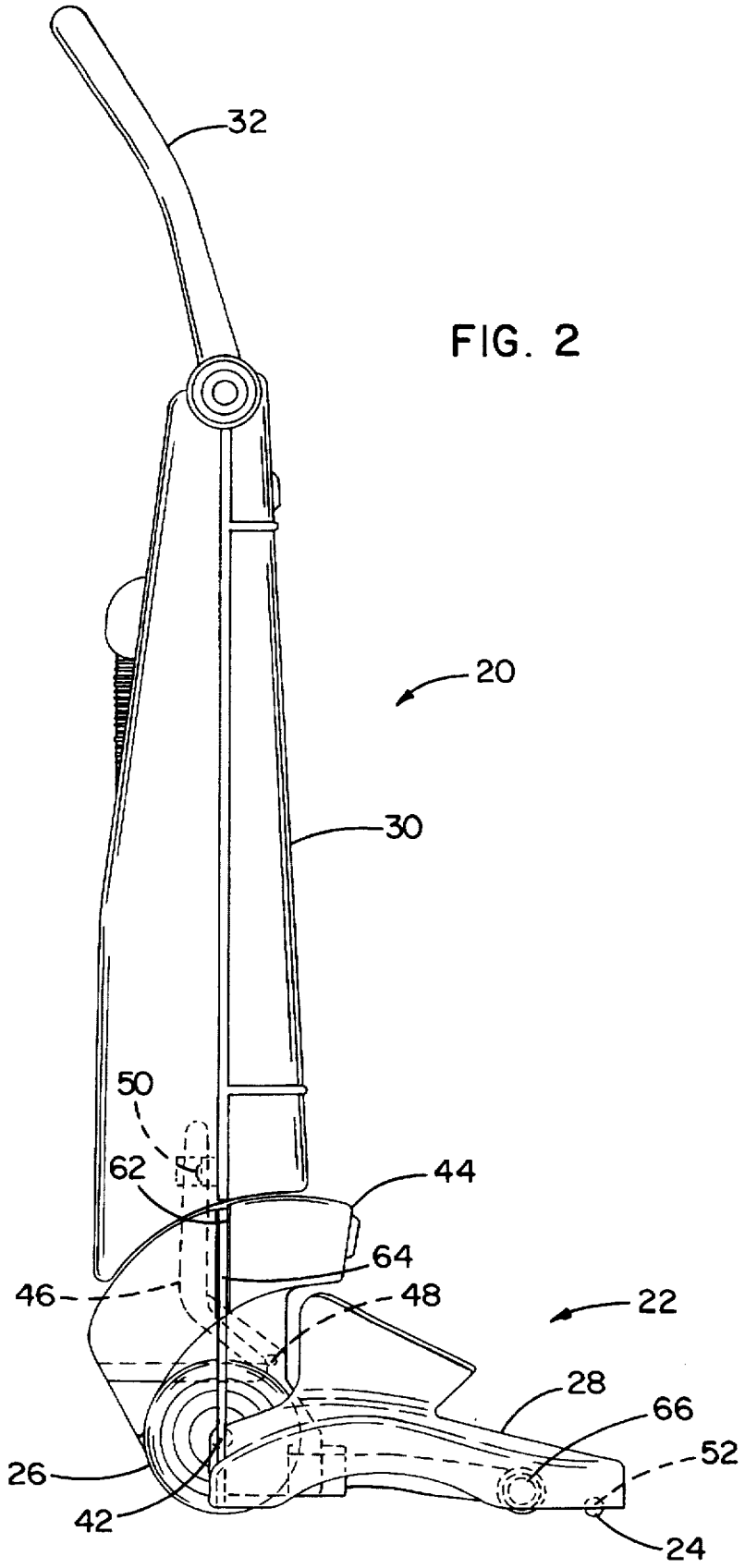
FIG. 2 is a side elevational view of the vacuum cleaner of FIG. 1.

Turning now to the drawings, FIGS. 1 and 2, respecitvely, show a front and side views of a vacuum cleaner 20 constructed in accordance with teachings of the invention. The vacuum cleaner 20 includes a base (indicated generally as 22) which includes wheels 24, 26 covered by a hood 28. The vacuum cleaner further includes an upright portion 30 which includes a handle 32. The base 22 typically comprises a suction element for picking up particles, and a rotary brush unit, while the upright portion 24 typically encloses a detachable bag or receptacle for collection of the suctioned particles. (Inasmuch as the particular structure of these elements is not essential to operation of the invention, they are not specifically shown or identified in the drawings.) The upright portion 24 may also include an on/off switch 36. The vacuum cleaner 22 is generally propelled by a force applied to the handle 32 to manually propel the vacuum cleaner 20 along the floor in forward and backward movement. Self-driven vacuum cleaners are also known, and the vacuum cleaner of the present invention may also be self-propelled.

Figure 3:
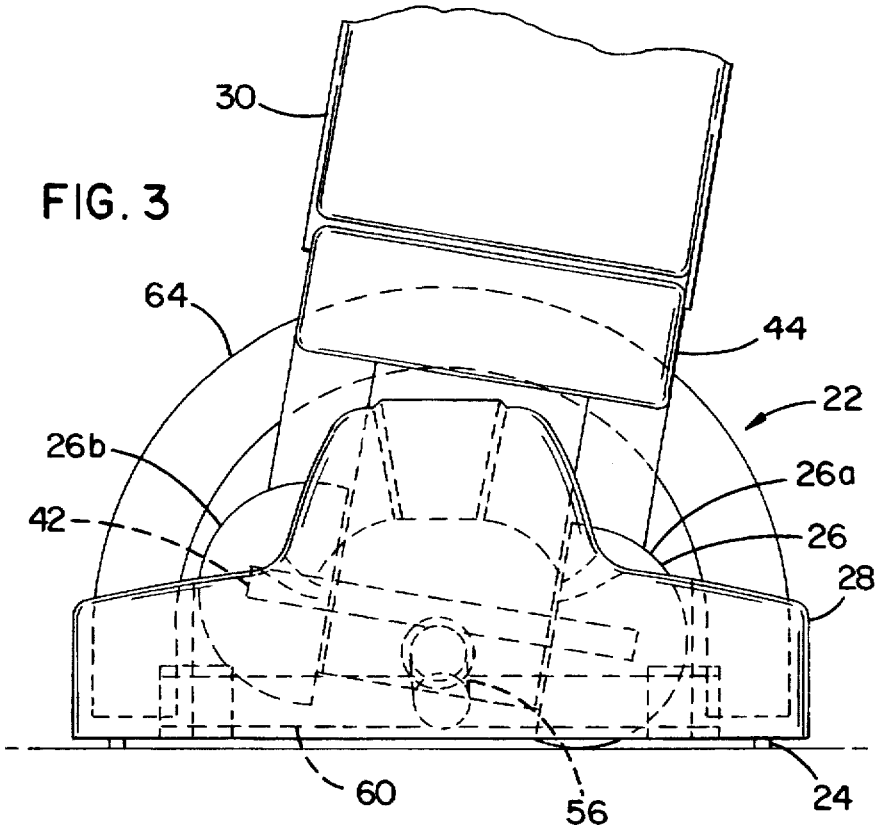
FIG. 3 is an enlarged fragmentary conceptual view of the vacuum cleaner shown in FIG. 1 wherein the upright portion and the rear wheels are positioned to steer the vacuum cleaner to one side.

In accordance with the invention, the vacuum cleaner 20 is provided with an articulation mechanism which permits the user to readily turn the vacuum cleaner 20 to either the right or left side. While the invention will be described with regard to the illustrated vacuum cleaner 20, it will be appreciated that the articulation mechanism by which the vacuum cleaner may be turned is equally applicable to other upright devices, such as a lawn mower, cart, or other device propelled using wheels along a surface. In order to facilitate turning, the rearward wheels 26 are hemispherically shaped and may be pivoted in a plane perpendicular to the floor so that only one of the rearward wheels 26 is disposed on the floor at a given time (as shown in the rear views of FIGS. 3 and 4). In this way, when the vacuum cleaner 20 is pushed forward or pulled backward, the vacuum cleaner 20 turns toward the side with a rear wheel 26 disposed on the floor. For example, when the rear wheels 26 are disposed with the left wheel **26*a* on the floor, as shown in FIG. 3, the vacuum cleaner 20 will turn to the left side when it is pushed or pulled. Similarly, when the rear wheels 26 are disposed with the right wheel 26*b* on the floor, as shown in FIG. 4, the vacuum cleaner 20** will turn to the right when it is pushed or pulled.

Figure 4:
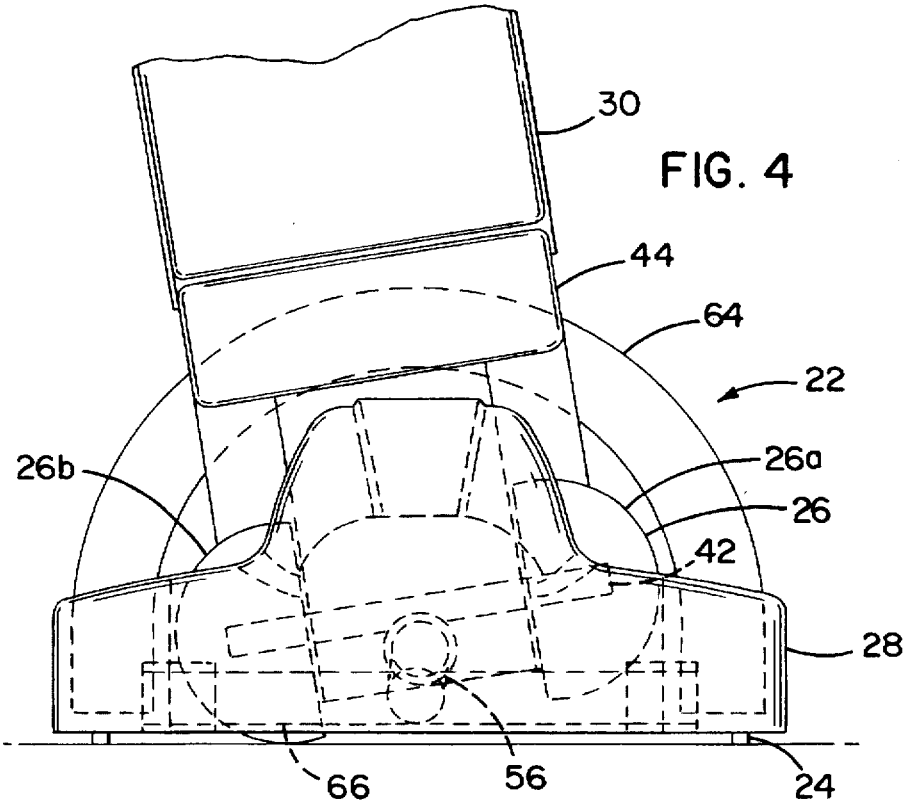
FIG. 4 is a conceptual view of the vacuum cleaner similar to that shown in FIG. 3 wherein the upright portion and the rear wheels are positioned to steer the vacuum cleaner to the opposite side.
Figure 5:
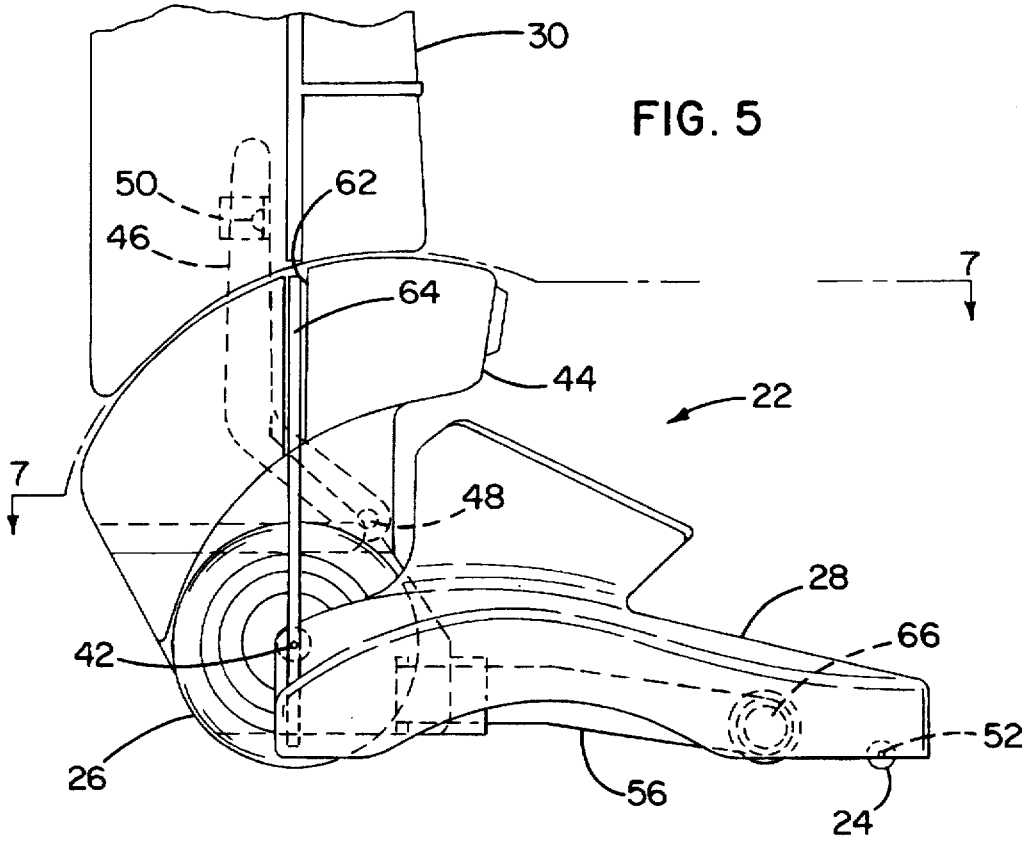
FIG. 5 is an enlarged fragmentary side view of the vacuum cleaner as shown in FIG. 2.
Figure 6:
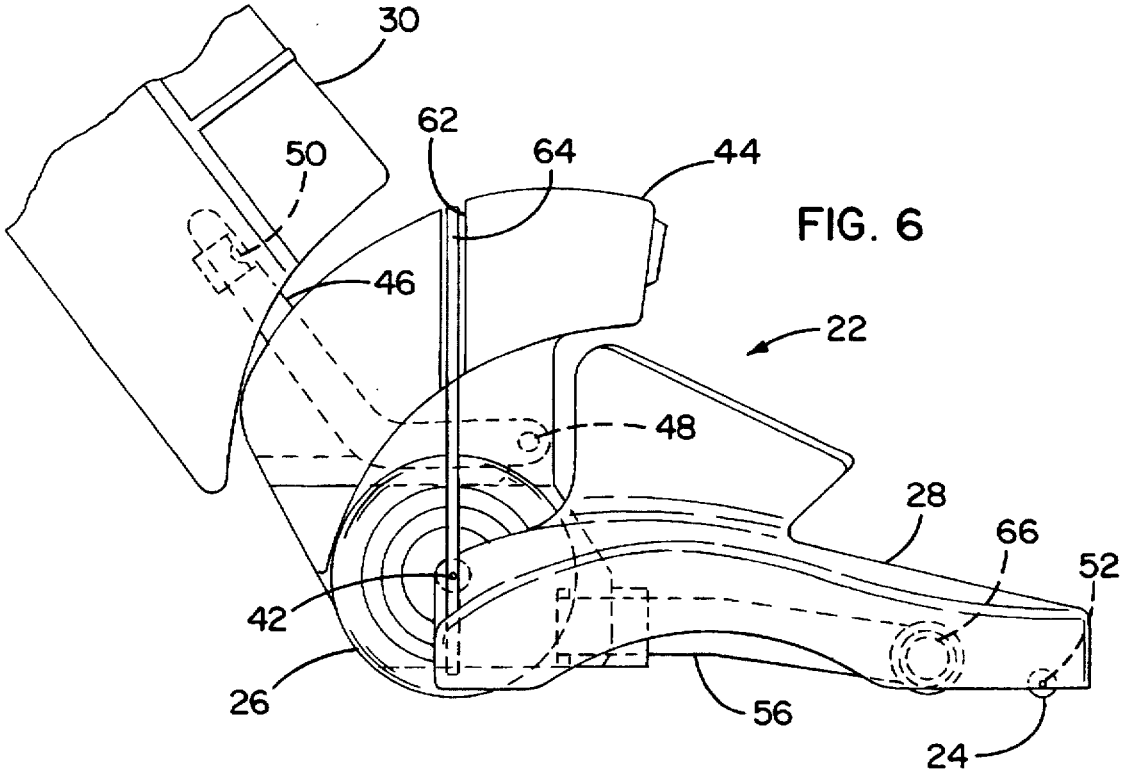
FIG. 6 is a fragmentary side view similar to that shown in FIG. 5, wherein the upright portion of the vacuum cleaner is pivoted to a rearward position.
Figure 7:
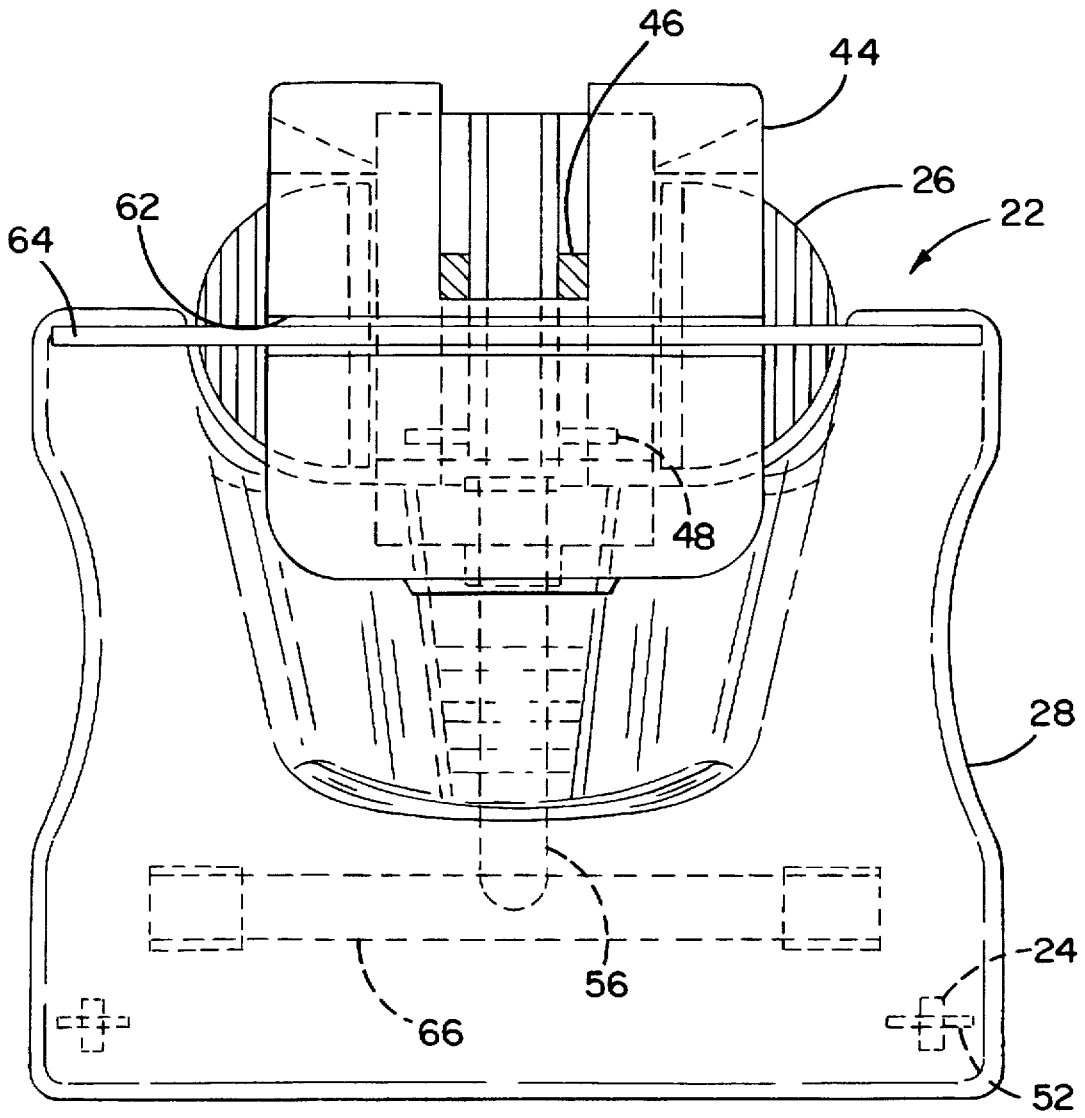
FIG. 7 is a top view of the vacuum cleaner taken along line 7—7 in FIG. 5.

Tilting of the rearward axis 42 is accomplished by manipulation of the upright portion 30 of the vacuum cleaner 20 from side to side as shown in FIGS. 3 and 4. As shown in FIGS. 5 and 6, the upright portion 30 may also be pivoted forward and backward relative to the forward wheels 24, rearward wheels 26, and hood 28. The upright portion 30 may be coupled to the rearward wheels 26 and rearward axis 42 by any appropriate means which permits the user to tilt the rearward axis 42 from side to side. In the preferred embodiment shown in the drawings, a rearward housing 44 is coupled to the rearward axis 42, and, accordingly, the rearward wheels 26. A pair of lever arms 46 are each pivotably coupled at point 48 to the rearward housing 44, and secured to the upright portion 30 at their opposite end 50. As best seen in FIGS. 5 and 6, the lever arms 46 and upright portion 30 pivot about point 48 as the upright portion 30 is lowered toward the ground or raised to its upright position. Pivot point 48 nests in the housing between the rearward wheels 26 as shown in FIG. 7.

It will be appreciated that the forward wheels 24, the forward axis 52, and the hood 28 remain substantially parallel to the surface to be vacuumed as the upright portion 30 is pivoted backward and forward (as shown in FIGS. 5 and 6) and tilted from side to side (as shown in FIGS. 3 and 4). The relationship between the forward and rearward wheels 24, 26 is unaffected by the backward and forward movement of the upright portion 30 (FIGS. 5 and 6).

In order to permit the forward wheels 24 to remain on the ground during turning maneuvers, however, means are provided which permit pivotal movement of the rearward axis 42 relative to the forward axis 52 as the rearward wheels 26 and axis 42 are pivoted (as shown in FIGS. 3 and 4). While any appropriate means may be utilized, in the preferred embodiment (see FIGS. 5 and 7), a base member 56 is provided which couples the forward and rearward wheels 24, 26 such that the rearward axis 42 may pivot in a plane which is substantially perpendicular to the floor. The base member 56 is coupled to both the rearward housing 44 (and consequently the rearward wheels and axis 26, 42) and the forward axis 52 (and consequently the forward wheels 24 and hood 28). To permit relative movement between the forward and rearward axes 52, 42, the base member 56 is rotationally coupled to one or the other. In the preferred embodiment, the base member 56 is secured to the rearward housing 44 and rotatably coupled to the forward axis 52 by way of a bracket 58.

Figure 8:
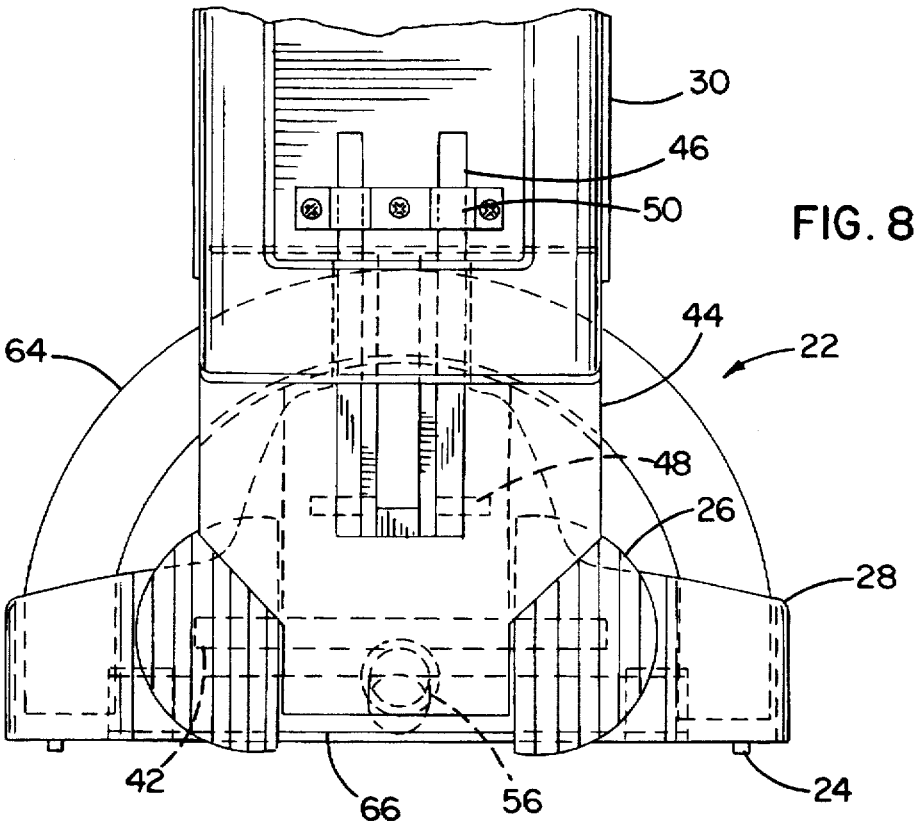
FIG. 8 is a rear view of the vacuum cleaner shown in FIG. 5.
Figure 9:
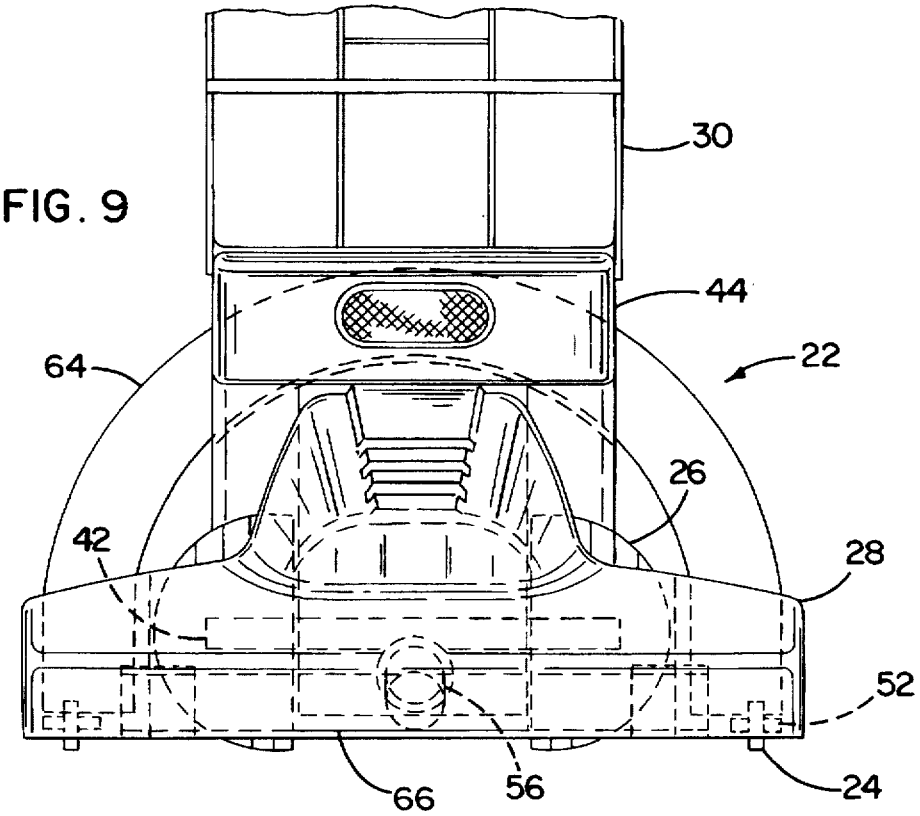
FIG. 9 is a front view of the vacuum cleaner shown in FIG. 5.

In order to further stabilize the positions and relative movement between the rearward and forward axes 52, 42, the rearward housing 44 and the hood 28 are provided with mating, stabilizing elements. The rearward housing 44 is provided with a channel 62. The hood 28 is provided with an arched element 64 which extends upward from the rearward portion of the hood 28. The arched element 64 is slidably disposed in the channel 62, as may be seen in FIGS. 7–9. As the rearward housing 44 is pivoted (as shown in FIGS. 3 and 4), the channel 62 slides along the arched element 64. It will be appreciated that this slidable engagement between the rear housing 44 and arched element 64 of the hood 28 provides added stability between the components of the vacuum cleaner 20 during use.

Figure 10:
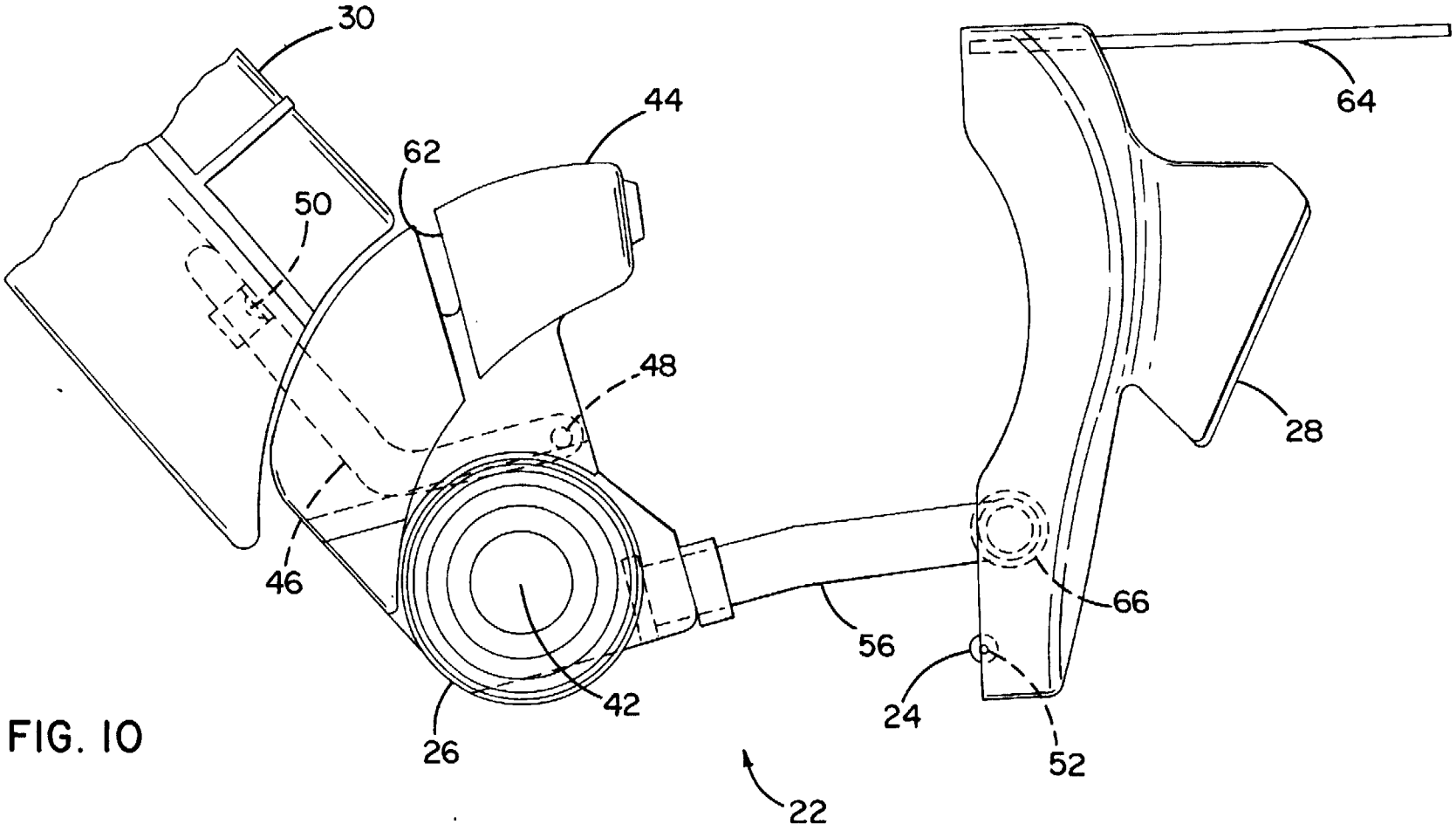
FIG. 10 is a side view of the vacuum cleaner of FIG. 6 wherein the hood portion is pivoted to an open position.

In accordance with another feature of the invention, means are provided whereby the working elements such as belts and brushes (not shown in the drawings) normally disposed beneath the hood 28 may be exposed without lifting all four wheels 24, 26 off of the floor and turning the entire vacuum cleaner 20 over. As shown in FIG. 10, the hood 28 is pivotably coupled to the base member 56 such that the hood 28 may pivot away from the rear housing 44 and the base member 56 to expose the working elements housed beneath the hood 28. In the currently preferred embodiment, the base member 56 is secured to a cross-member 66 which is, in turn, pivotably coupled to the hood 28 (see FIGS. 6, 7 and 10). To facilitate movement of the hood 28 from the position shown in FIG. 6 to the position shown in FIG. 10, the arched element 64 may be used as a handle.

To provide further ease of use, the handle 32 of the vacuum cleaner 20 may be formed in an inverted U-shape, as shown in FIG. 1. In this way, the user may grasp the handle 32 along any of the three elongated portions or the user may use both hands in maneuvering the vacuum cleaner 20. It will be appreciated that the inverted U-shaped handle 32 likewise provides added leverage as the user maneuvers the handle 32 to twist the upright portion 30 and thus tilt the rearward axis 42 from a horizontal position during turning operations.

Another feature of the invention which provides added convenience to the user is a large on/off switch 36, which is centrally disposed along an upper surface of the upright portion 30. The vacuum may additionally include such features as a spring loaded or automatically retractable power cord.

In summary, the invention provides a vacuum cleaner which is "user-friendly," particularly to those with physical impairments. The user may simply tilt the upright portion 30 of the vacuum cleaner 20 to pivot the rearward axis 42 and wheels 26 and cause the vacuum 20 to turn. Moreover, the hood 28 may be tilted forward to expose working elements of the vacuum 20, such as the brushes and belts. Finally, features such as a uniquely shaped handle 32, a prominently disposed on/off switch 36, and a retractable cord provide added convenience to the user.

It is to be understood that the invention may include additional embodiments and that any allowed claims based on this application are to be accorded a range of equivalence commensurate in scope with advances over the prior art.

I claim as my invention:

1. A vacuum cleaner having improved maneuverability for moving over a surface, the vacuum cleaner comprising:

a base portion including spaced forward wheels having a forward axis, a pair of hemispherically shaped rearward wheels having a rear axis, and a base member coupling the forward wheels and the rearward wheels such that the rear axis is pivotable in a plane generally perpendicular to the surface, only one of the rearward wheels being disposed on the surface when the rear axis is pivoted from a generally horizontal position; and an upright portion coupled to the rearward wheels for pivoting the rear axis in the plane generally perpendicular to the surface, whereby the vacuum cleaner may be caused to move in a generally straight direction when both of the rearward wheels are disposed on the surface, and the vacuum cleaner may be caused to turn when the rear axis is pivoted from a generally horizontal position and only one rear wheel is disposed on the surface.

2. The vacuum cleaner of claim 1 further comprising a hood, the hood having a forward end substantially adjacent the forward wheels, and a rearward end disposed substantially adjacent the rearward wheels, the hood being pivotably coupled to the forward axis such that the rearward end of the hood may be pivoted upward relative to the surface.

3. The vacuum cleaner of claim 2 further comprising a handle disposed substantially along the rearward end of the hood for use in pivoting the hood upward relative to the surface.

4. The vacuum cleaner of claim 3 wherein the handle is in the form of an arched element, the arched element extending in a plane substantially perpendicular to the surface and being coupled to the rearward end of the hood.

5. The vacuum cleaner of claim 4 further comprising a rearward wheel housing coupled to the rear axis such that the rearward wheel housing likewise pivots as the rear axis is pivoted, the rearward wheel housing having an upper surface disposed opposite the surface and including a channel along the upper surface, the arched element being disposed within the channel such that the arched element acts to stabilize the rearward wheel housing as the rearward wheel housing pivots.

6. The vacuum cleaner of claim 1 further comprising a hood, an arched element, and a rearward wheel housing, the hood having a forward end substantially adjacent the forward wheels, and a rearward end disposed substantially adjacent the rearward wheels, the arched element extending in a plane substantially perpendicular to the surface and being coupled to the rearward end of the hood, the rearward wheel housing being coupled to the rear axis such that the rearward wheel housing likewise pivots as the rear axis is pivoted, the rearward wheel housing having an upper surface disposed opposite the surface and including a channel along the upper surface, the arched element being disposed within the channel such that the arched element acts to stabilize the rearward wheel housing as the rearward wheel housing pivots.

7. The vacuum cleaner of claim 1 wherein the base member comprises a generally forwardly extending rod which is rotatably coupled to the forward axis.

8. The vacuum cleaner of claim 1 wherein the base member comprises a generally forwardly extending rod which is rotatably coupled to the rear axis.

9. The vacuum cleaner of claim 1 further comprising a hood pivotably coupled to the forward axis, and wherein the base member comprises a generally forwardly extending member which rotatably couples the forward and rear axes, and a laterally extending member which extend generally perpendicularly to the forwardly extending member, the laterally extending member being pivotably coupled to the hood to provide relative movement between the hood and the base member.

10. The vacuum cleaner of claim 1 wherein the upright portion further comprises a handle, the handle having an inverted U-shape.

11. The vacuum cleaner of claim 10 further comprising a spring loaded retractable power cord.

12. The vacuum cleaner of claim 10 wherein the upright portion has a substantially rectangular shape and an upper surface opposite the rearward wheels, the handle portion being disposed along the upper surface, the vacuum cleaner further comprising an on/off switch slidably disposed along the upper surface.

13. An articulable wheeled device for rolling on a surface, the device comprising:

a wheelbase including spaced forward wheels having a forward axis, a pair of hemispherically shaped rearward wheels having a rear axis, and a base member coupling the forward wheels and the rearward wheels such that the rear axis is pivotable in a plane generally perpendicular to the surface, only one of the rearward wheels being disposed on the surface when the rear axis is pivoted from a generally horizontal position; and a handle coupled to the rearward wheels for pivoting the rear axis in a plane generally perpendicular to the surface, whereby the device may be caused to move in a generally forward direction when both the rearward wheels are disposed on the surface and the device may be caused to turn when the rear axis is pivoted from a generally horizontal position and only one rear wheel is disposed on the surface.

* * * * *